United States Patent [19]

Latimer

[11] 4,387,518

[45] Jun. 14, 1983

[54] SEPARABLE LIQUID FLOW SCREENING MEANS FOR EXCLUDING OVERSIZED, SLENDER OBJECTS CARRIED BY A LIQUID, AND DREDGE MEANS INCLUDING SAME

[75] Inventor: John P. Latimer, Newport News, Va.

[73] Assignee: Deepsea Ventures, Inc., Gloucester Point, Va.

[21] Appl. No.: 271,550

[22] Filed: Jun. 8, 1981

Related U.S. Application Data

[63] Continuation-in-part of Ser. No. 232,835, Feb. 9, 1981, Pat. No. 4,347,765.

[51] Int. Cl.[3] ..... E02F 3/94; B07B 1/16; B07B 1/28; B01D 35/12

[52] U.S. Cl. ..... 37/57; 37/DIG. 8; 138/42; 209/250; 209/260; 209/379; 209/675; 210/159; 210/236

[58] Field of Search ..... 209/250, 262, 263-267, 209/356, 379, 660, 675, 260; 299/8; 37/57, 58, DIG. 8; 406/152; 55/436, 440; 134/16, 104, 116; 210/225, 230, 328, 159, 236; 138/42

[56] References Cited

U.S. PATENT DOCUMENTS

| | | | |
|---|---|---|---|
| 459,326 | 9/1891 | Wiesebrock | 210/230 X |
| 675,514 | 6/1902 | Lockhart | 299/8 |
| 867,984 | 10/1907 | Lake | 209/250 X |
| 1,129,351 | 2/1915 | Lake | 299/8 |
| 1,834,981 | 12/1931 | Stebbins | 55/440 X |
| 2,579,282 | 12/1951 | Vicard | 55/440 X |
| 2,976,954 | 3/1951 | Irwin | 55/440 X |
| 3,011,645 | 12/1961 | Lenzini | 210/328 |
| 3,050,504 | 10/1962 | Lavellee | 210/328 |
| 3,179,116 | 4/1965 | Jacobs | 134/104 X |
| 3,276,193 | 10/1966 | Lamb | 55/436 X |
| 3,360,130 | 12/1967 | Kaga | 210/225 |
| 3,391,786 | 7/1968 | Beakie | 210/328 X |
| 3,693,328 | 9/1972 | Paucha | 55/436 |
| 4,225,188 | 9/1980 | McGuire | 55/440 X |
| 4,292,173 | 9/1981 | Parmentier | 210/275 |

FOREIGN PATENT DOCUMENTS

| | | | |
|---|---|---|---|
| 456370 | 2/1928 | Fed. Rep. of Germany | 55/436 |
| 489150 | 1/1930 | Fed. Rep. of Germany | 55/436 |
| 747499 | 7/1980 | U.S.S.R. | 210/328 |

*Primary Examiner*—David L. Lacey
*Attorney, Agent, or Firm*—Barry G. Magidoff

[57] ABSTRACT

This invention provides means to screen long, slender objects from a flowing fluid, and more particularly provides means to clear jammed objects therefrom. The screening means comprises a set of opposed, aligned, undulating surfaces, preferably formed as corrugated plates, located within a conduit, that can be moved apart to permit the removal of trapped debris. The plates are so mounted as to be transversely movable relative to the conduit, and are each movable relative to the adjacent plates so as to permit increasing the separation between adjacent plates when the plates are moved to outside of the conduit. The liquid screening means of this invention can usefully be included in a suction type dredging device, between the inlet nozzle and the pump.

16 Claims, 7 Drawing Figures

100b
123
198
93
98
108
24
122
101
90
187
86b
151
121
186
87

84
86b
186
90
198
100b
122
93
6
200
87
88
131
134

SEPARABLE LIQUID FLOW SCREENING MEANS FOR EXCLUDING OVERSIZED, SLENDER OBJECTS CARRIED BY A LIQUID, AND DREDGE MEANS INCLUDING SAME

This application is a continuation-in-part of my copending application Ser. No. 232,835 filed Feb. 9, 1981, now U.S. Pat. No. 4,347,765.

This invention is directed to means for dredging particles from the floor of a body of water, and especially protecting the dredging devices used for the mining of ocean floor nodule ores from the surface of the ocean floor, by limiting the intake of oversize particles.

With the recognition that terrestial sources for raw materials, especially ores, are being swiftly depleted, effort has been made to obtain these valuable industrial raw materials from other sources, most especially the abyssal depths of the oceans. Such sources are generally to be found at depths of between 10,000 and 18,000 feet, requiring extremely deep water dredging means. The most valuable ores found to date are known as ocean floor ores, or manganese nodules. These materials are often found as relatively small particulate forms, including fist-sized rocks or smaller pebbles or elongated pieces, or even as grains of sand. In addition to the ore particles, the ocean floor is also littered with the detritus of eons of ocean use by man as well as by the lower orders of animals, such as pieces of flotsam from man's manufactured ships, or the hard, durable, often fossilized, remains of dead animals, such as the bones of large fish or sea mammals.

A great deal of engineering effort has been undertaken to date to secure these ores and bring them to the surface for further processing.

The deposits of these valuable metal ores are often lying on the surface of the soft sea floors, in the form of fist-sized rocks, often partially immersed within a sediment layer on the ocean floor. The exact size of the ore pieces vary greatly, from relatively small pebbles or even sand-like grains, up to large rock or even boulders. The smaller of such ore pieces can be directly secured by one form of mining machine designed to date, and that is the suction head dredge vehicle.

Such a suction-type dredging apparatus literally sucks the ore particles, much in the way of a vacuum cleaner, into the mining system, eventually transferring the thus collected particles via elevator means from the dredge vehicle to a surface vessel. The present preference is to carry the ore particles to the surface vessel entrained in liquid, especially sea water, and most especially in an airlift system.

When dredging for the valuable nodule ores at the bottom of the ocean, the ore gathering device should be as efficient and as durable as possible, in order to compensate for the great expense of collecting the ore from a location at least about 3 miles beneath the surface of the ocean. The suction effect of the nozzle has been made sufficiently great to be able to literally tear out the ore particles that are embedded within the silt and mud on the ocean floor. Of necessity, this results in the intake of not only the desired nodules, but also of the varied detritus mixed with the ore. That material that is the same size as the desired ore particles is picked up and carried through the dredge vehicle with no difficulty. The larger detritus as well as oversize ore particles have been screened out by conventional means, such as mesh work or parallel or otherwise placed rods over the intake to the nozzle. There can, however, be a problem with long slender pieces that could pass through the prior screening means if they are oriented along the longer axis. Once inside the system, they are capable of jamming the flow ducts, or even of causing serious damage to the system, for example, to a pump impeller on the dredge vehicle. This would necessitate halting dredging and perhaps bringing the dredge up to the surface for repairs.

In accordance with the present invention, means are provided to collect particulate solids from the bottom of a body of water, and more especially from the ocean floor, utilizing a negative pressure, or suction, to draw, e.g., the ore particles, into the collection system, and including specifically means to provide for the improved protection of the ore collection system by the screening of particles about all three dimensions. In particular, this invention is most effectively used in the context of a suction nozzle and dredge head assembly, adapted for gathering objects from the ocean floor, the assembly comprising a nozzle having a nozzle opening adjacent a first end thereof, the nozzle and dredge head assembly having interconnected internal surfaces defining a fluid flow conduit for the flow of fluids, from the nozzle opening through the nozzle assembly and the dredge head assembly, and inlet means designed to provide a fluid-flow connection from the dredge head assembly to elevator means for carrying dredge material from the ocean floor to the ocean surface. The improvement comprises screening means for excluding long slender objects, the screening means comprising a set of a plurality of plates having complementary opposed pairs of undulating, or corrugated, e.g., folded or dimpled, surfaces formed thereof; the opposed surfaces define undulating, restricted parallel flow passages through a portion of the conduit. There is also provided means for permitting the release of solid debris captured by and trapped within the restricted flow passages. Such means provide for remotely opening a first side of the conduit adjacent the corrugated plates and for remotely moving at least some of the plates to outside of the conduit, while at least instantaneously increasing the distance separating adjacent plates when the plates are outside of the conduit.

Preferably, the plurality of plates are supported within the fluid flow conduit, each plate being secured to an internal surface of the conduit, and extending between opposing sides of the conduit, so as to divide the conduit into, preferably, several curved flow passages. The plates are separated so as to prevent the passage of objects having dimensions greater than a predetermined value. The plates themselves could be constructed out of porous material, e.g., a mesh, to limit the drag on the flowing fluid, or a nonporous material. However, the plates are preferably rigid.

The release means comprise means to move the undulating plates relative to each other and/or relative to the internal surfaces of the main conduit, or duct. The undulating plates are movably connected to one of the internal surfaces of the duct and to each other.

A further understanding of the present invention can be obtained by reference to the preferred embodiments set forth in the illustrations of the accompanying drawings. The illustrated embodiments, however, are merely exemplary of certain presently known preferred means for carrying out the present invention. The drawings are not intended to limit the scope of this invention, but merely to clarify and exemplify, without being exclusive thereof.

Referring to the drawings.

The present invention for the screening of long slender particles can be most effectively used in the context of a suction dredge system for the mining of ocean floor nodule ores. Such a system is shown in the co-pending previously filed application Ser. No. 232,835 filed Feb. 9, 1981. The description of that system is hereby incorporated by reference, particularly relevant being those portions describing the dredge vehicle and the duct 24 connecting the dredge nozzle to the dredge pump and the location of the screening means in the duct 24.

Referring to FIGS. 1-4, mounted across the fluid carrying duct 24 is a corrugated plate system, generally indicated by the numeral 84, which extends beyond the side wall of the duct 24. Supported thereon by a mechanism described below are a series of pairs of mounting plates 86*a,b*. Adjacent pairs of mounting plates 86*a,b* support mutually parallel, corrugated screening plates 87.

As a further embodiment of the invention, a transverse screening member is secured transversely to each corrugated plate. Preferably, the transverse member is secured perpendicularly to the corrugated plate. A plurality of transverse members can be axially spaced along one surface of each corrugated plate.

Figure 5:
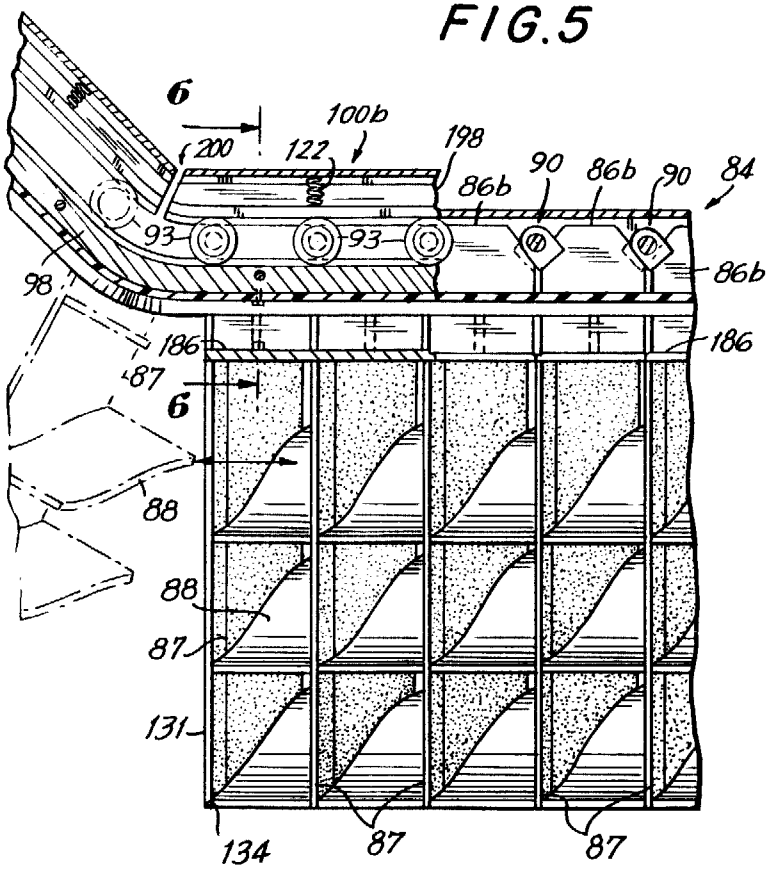
FIG. 5 is a section view along lines 5—5 of FIG. 4.

As shown in FIG. 5, a series of substantially parallel plates 88 are mounted on each primary corrugated plate 87. In the embodiment shown, the axes of the folds of the corrugations of the primary corrugated plates 87 extend substantially perpendicular to the direction of fluid flow (shown by the arrows of FIG. 4) and substantially perpendicular to the lower duct wall 132.

A further description of these perpendicular plates, and their purpose, is set forth in the co-pending application Ser. No. 232,835, filed Feb. 9, 1981.

Figure 7:
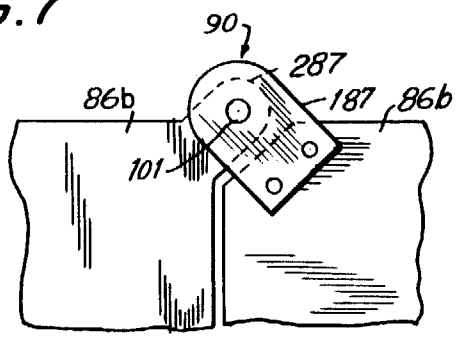
FIG. 7 is a magnified view of a portion of FIG. 5.
Figure 4:
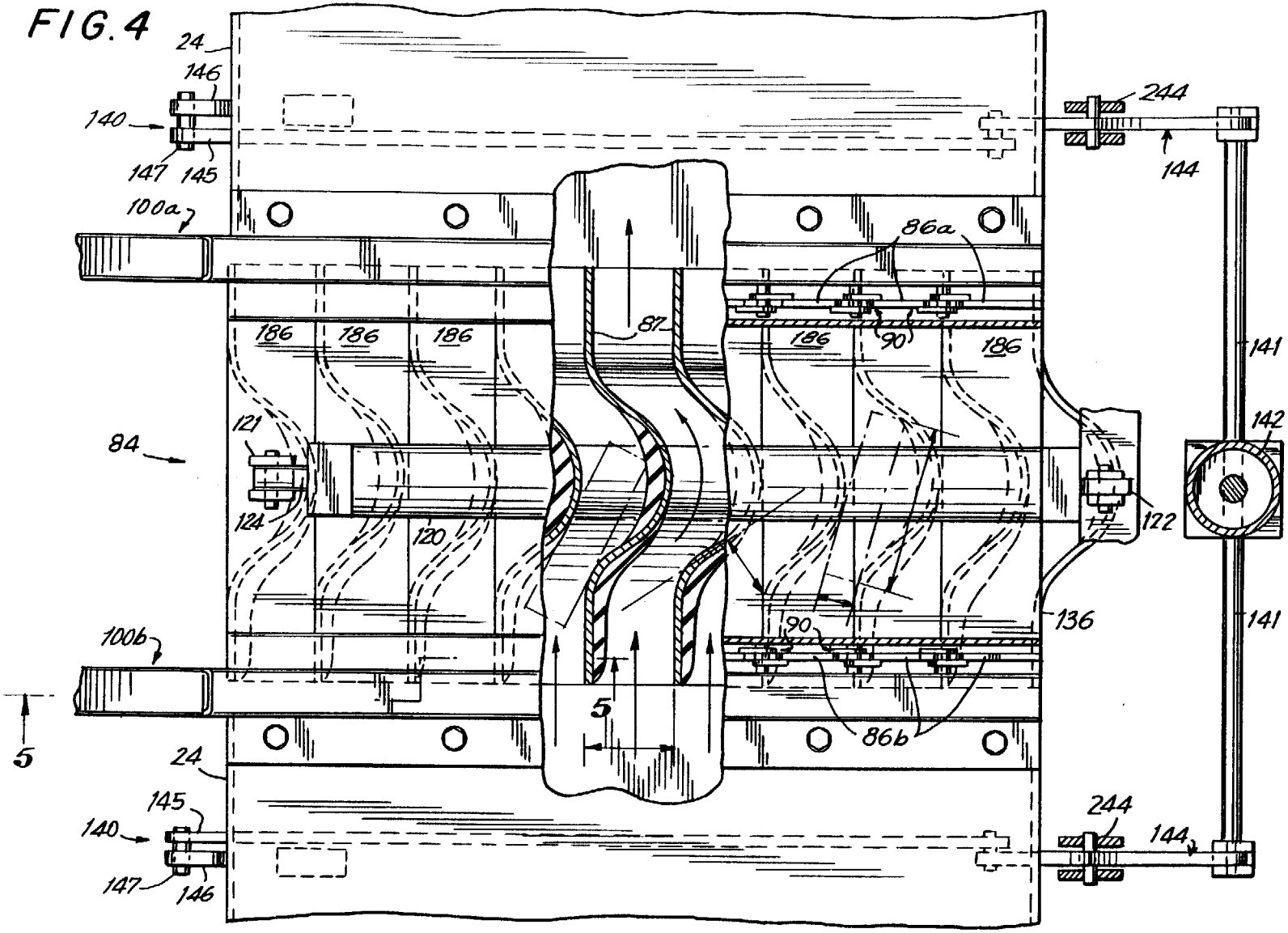
FIG. 4 is a top view of the embodiment of FIG. 3 in partial section taken along lines 4—4 of FIG. 3.
Figure 6:
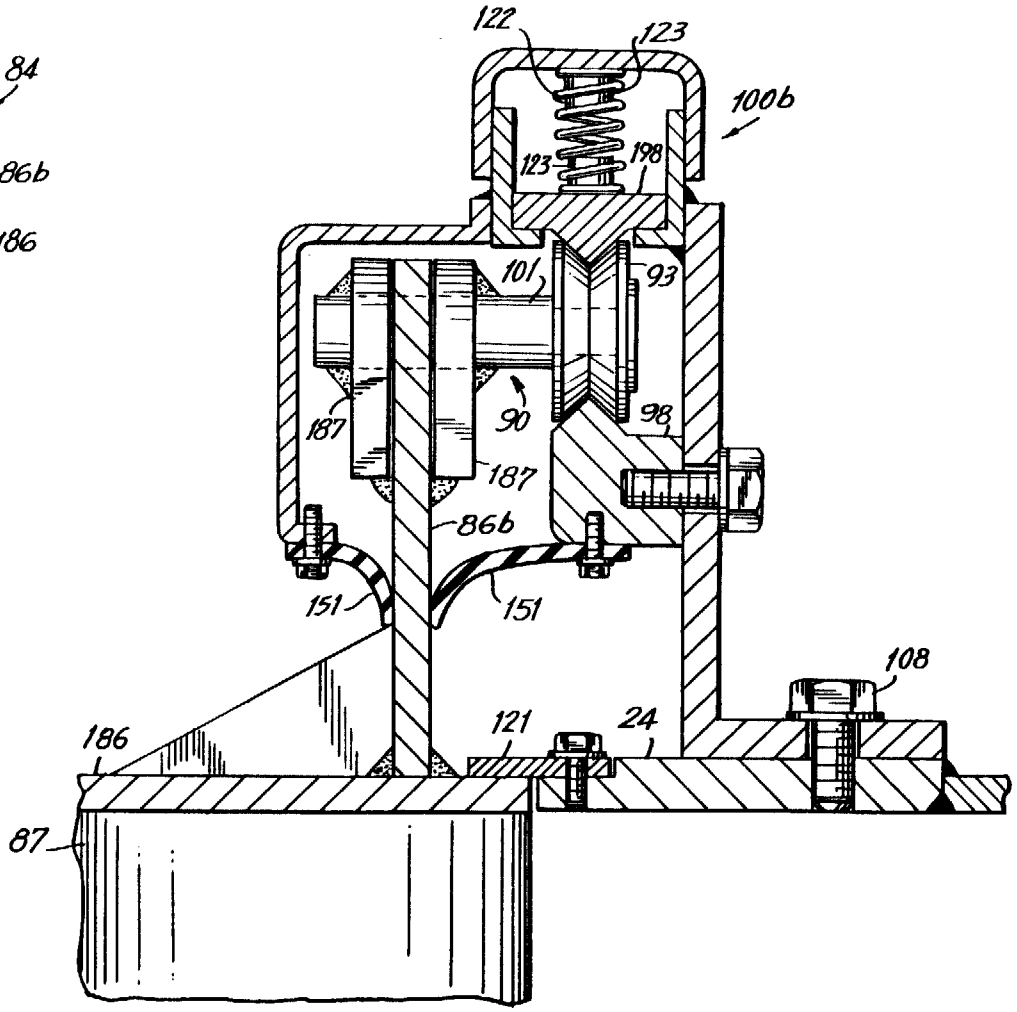
FIG. 6 is a section view along lines 6—6 of FIG. 5.

The mounting plates 86*a,b* are hingedly connected to one another by hinges generally indicated by the numeral 90, as shown in FIGS. 5 and 7. Each hinge 90 is rotatably connected (by axle 101) to a support roller 93. Each roller 93 is in turn mounted between and supported by mating roller tracks 98, 198. As shown in FIGS. 5 and 6, the two pairs of roller tracks 98, 198 are each supported within a track housing generally indicated by the numeral 100*a,b* and located above the top edge of the duct 24. The tracks and housing 100*a,b* extend across the width of duct 24 and beyond, the tracks 98, 198 bending upwardly and away from the plane of the top surface of the duct 24.

As shown in FIG. 6, the roller 93 is supported from below by lower track 98 and from above by upper roller track 198, both of which are tapered and designed to fit into the groove in the roller 93. The upper roller track 198 is resiliently supported within the housing 100*a,b* by spring 122.

Each track housing 100*a,b* is rigidly connected to the top plate of the duct 24 by a series of stove bolts 108. The lower support track 98 is rigidly connected to the track housing 100*a,b*.

Extending upwardly and outwardly from one upper corner of each mounting plate 86*a,b* is an earpiece 287. Extending from the opposite upper corner of each mounting plate 86*a,b* are a pair of earpieces 187 that sandwich the plate 86*a,b* and the single earpiece 287 extending from the immediately adjacent plate 86*a,b*. The roller axle 101 passes through all three earpieces 287, 187, at each hinge 90, but is rididly attached to each outer earpiece 187, but rotatably held by the inner single earpiece 287.

A horizontal upper plate 186 is rigidly connected between the support plate 86*a,b* and the corrugated plate 87; the series of horizontal plates 186 form the upper surface of the duct 24 above the corrugated plates 87. To minimize leakage, a flexible sealing strip 321 is pressed across each joint, i.e., between adjacent upper plates 186 and between the ends of each upper plate 186 and the stationary upper surface of the duct 24. Each sealing strip 321 is connected to the duct 24.

Extending centrally between the upper housings 100*a,b* is a hydraulic cylinder 120. The cylinder 120 is rotatably connected at one end to the main chassis support for the duct 24, by a hinge member 122. A piston rod 124 extends from the second end of the cylinder 120 and is reciprocally movably held therewithin. The free end of the piston rod 124 is rotatably connected to the top surface of the outermost horizontal plate 186, by hinge member 121.

To increase the likelihood of completely clearing a possible jam in the screen system, which is understandably important for a device intended to operate at the bottom of the ocean, the far side wall and the lower plate of the duct 24, adjacent the corrugated plates, swing outwardly. As shown, the far side wall 131, and the lower plate 132 are hingedly connected by, e.g., a piano hinge 134. Similarly, the lower plate 132 is hingedly connected, as by piano hinge 135, to the stationary duct wall. The lower plate 132 and the side plate 131 extend beyond the corrugated plate system 84, at both the upstream and downstream ends thereof.

The hinged side plate 131 and lower plate 132 are moved by a pair of lever systems generally indicated by the numeral 140. A hydraulic cylinder 142 is attached to the main chassis by pin 242 and contains a piston rod 143 reciprocally movable therewithin, to activate the lever systems 140. The piston rod 143 is secured to a cross bar 141, each end of which is hingedly connected to one end of an angled lever rod 144 , which is pivotally connected about its apex 244 to the main chassis. The second end 344 of angled rod 144 is pivotally connected to one end of a long lever 145, which is in turn pivotally connected about its second end to a side lever 146, by way of a hinge 147. The second end of the side lever 146 is rigidly connected to the side plate 131 and hingedly connected to the lower plate 132, about hinge 134. The plate hinges 134, 135 are preferably spring-loaded such that the side plate 131 pivots outwardly before the lower plate 132 moves downwardly, and the lower plate 132 closes upwardly before the side plate 131 closes. The stop member 137 limits the pivoting movement of the side lever 146.

The hydraulic cylinder and piston 143 are preferably spring-loaded to maintain the system in the closed condition if hydraulic pressure fails.

Figure 1:
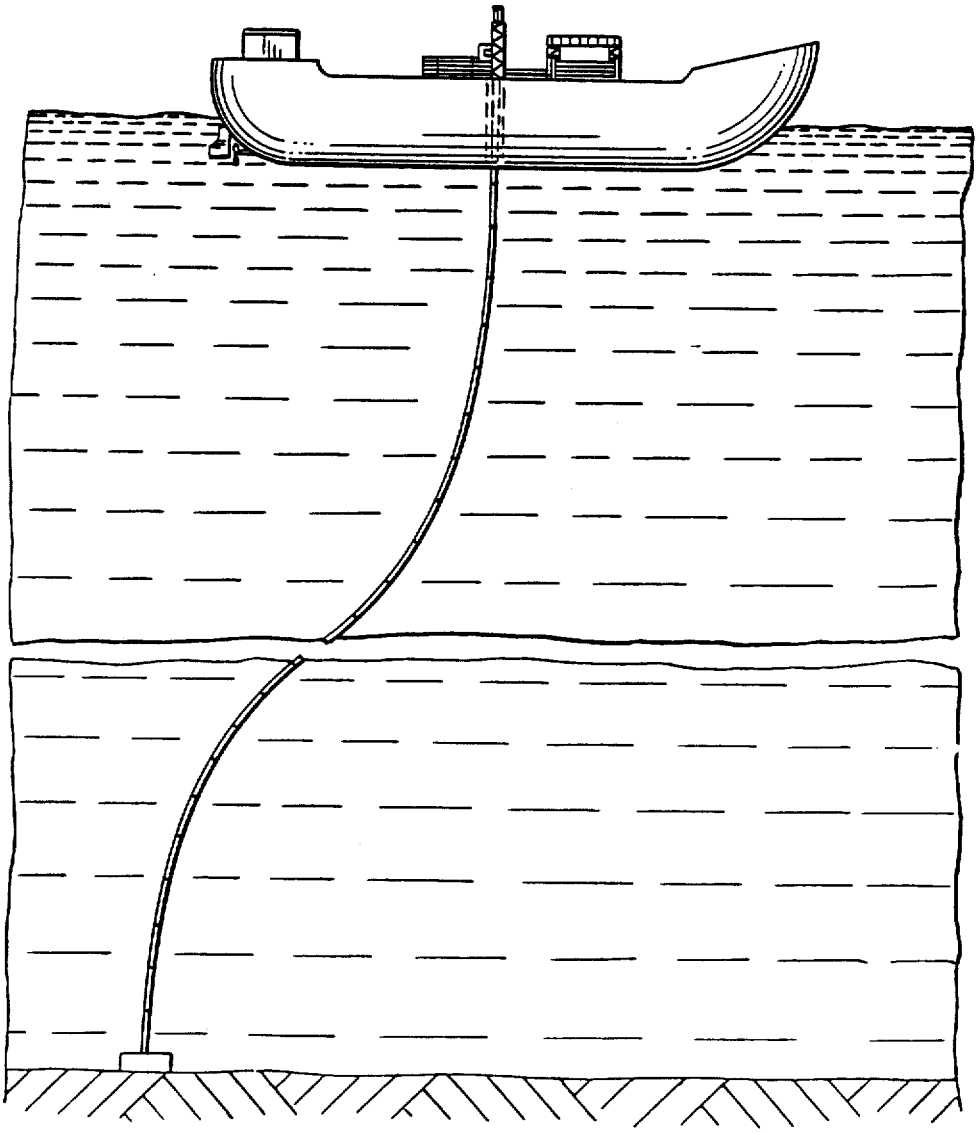
FIG. 1 is a diagram of a surface vessel towing a dredge vehicle of the type to include this invention.
Figure 2:
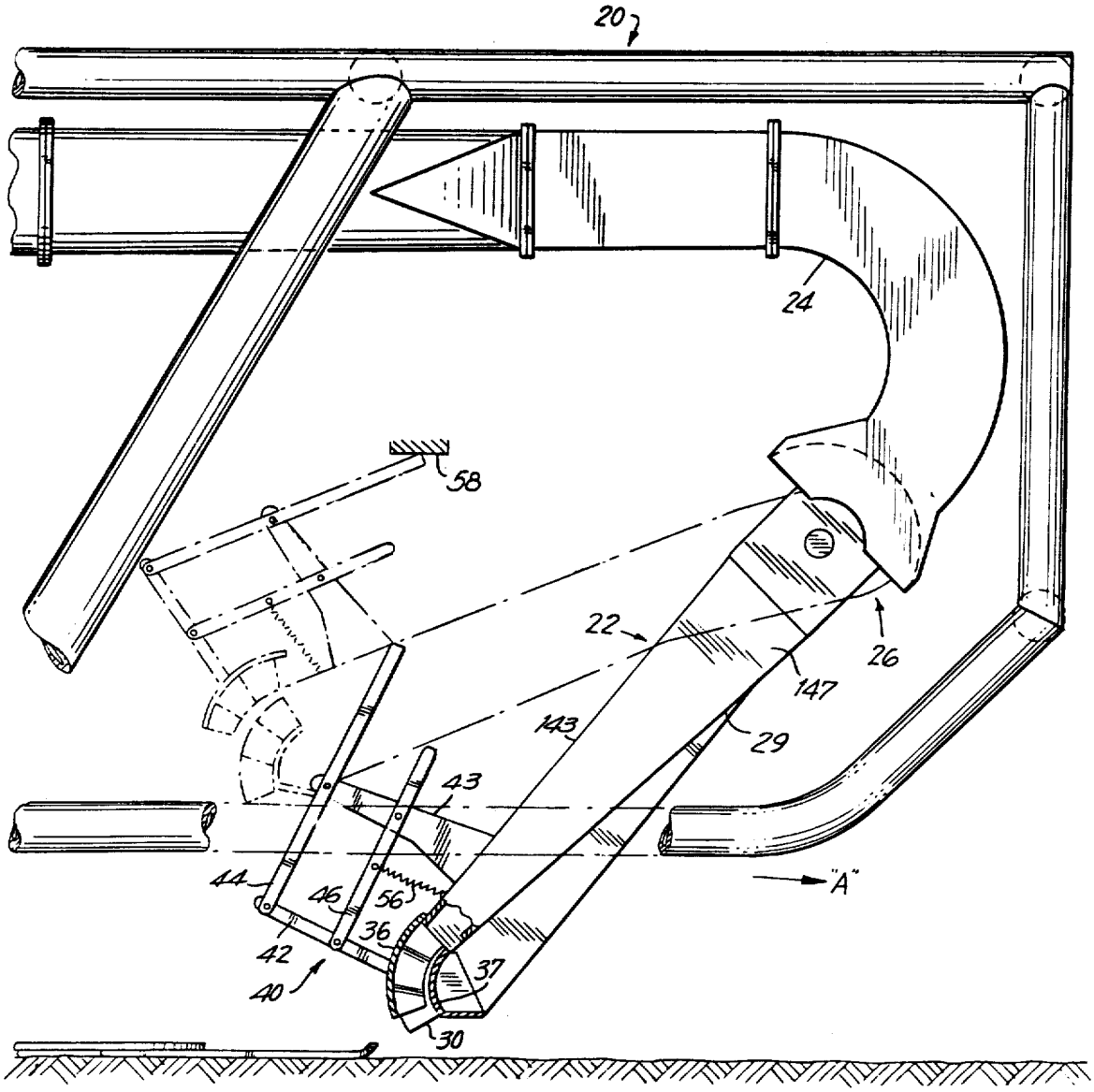
FIG. 2 is a side view of a dredge vehicle including this invention.
Figure 3:
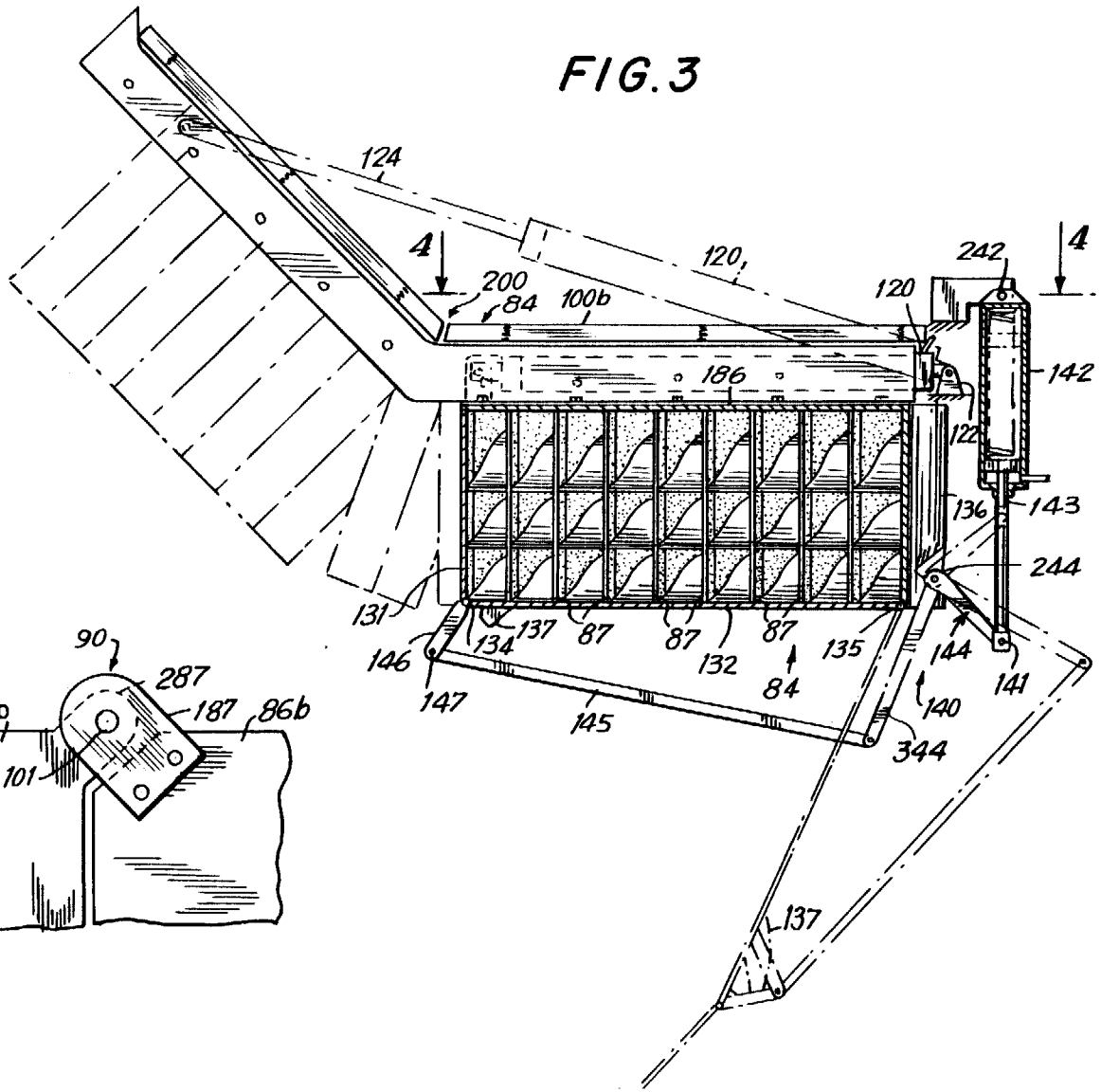
FIG. 3 is a cross-sectional elevation view of one embodiment of the present invention in a dredge conduit.

In the operation of an ocean floor dredge system including the present invention, the dredge can be moved forwardly, in the direction shown by the arrow "A" in FIG. 2 by, for example, a surface vessel, as shown in FIG. 1. The suction pump, located within the duct 24 downstream of the portion shown in FIG. 2, is activated to draw a stream of water into and through the nozzle opening 30, bringing into the nozzle together with the water the solid particles to be found on the ocean floor. The stream flows into the nozzle opening upward through the nozzle 22, through a portion of duct 24, then through the curved flow channels formed by the corrugated plates 87, within the duct 24, then through the remainder of duct 24, to the pump impeller chamber.

In the event of a plug forming in the duct, for example, by oversized particles being jammed between the corrugated plates 87, the plug being indicated by a decrease in pressure within the duct 24 upstream of the screening system 84, the corrugated plates can be separated and the duct 24 opened around the plates. First, the side hydraulic cylinder 142 is activated to move the piston rod 143 upwardly from the closed position (shown by solid lines in FIG. 3) to the open position (shown by phantom lines in FIG. 3). This causes the pivoting of the angled lever 144, which in turn moves the long lever 145 and the side lever 146, until the side lever moves against the stop member 137, at which point the side plate 131 has been opened, to the angle shown by phantom lines in FIG. 3, relative to the lower plate 132. Thereafter, continued pivoting movement of the angled lever 144 causes the lower plate 132 to swing downwardly, to the position shown by phantom lines in FIG. 3.

After the side plate 131 and the lower plate 132 are fully opened, the upper hydraulic cylinder 120 is activated, pushing the piston rod 124 outwardly. The piston rod 124 pulls the series of hingedly connected corrugated plates 87 outwardly and upwardly along the tracks 198, 98. As each roller 93 moves around the upward bend 200 in the tracks 98, 198, the corrugated plate 87 to which the roller 93 is attached (through the support plates 86 and horizontal plate 186) swings outwardly about the hinge 90. As is shown by the phantom lines in FIGS. 3 and 5, the spacing between the adjacent corrugated plates is thereby substantially increased at the bend. This permits any material jammed between those plates 87 to drop out. The piston rod 124 continues to move outwardly until all but the final one of the corrugated plates have passed around the track bend, permitting any jammed material to be expelled. As shown, the hydraulic cylinder 120 and the piston rod 124 pivot about their respective hinges 121, 122 to accommodate the upward movement along the angled tracks 98,198.

After the jammed material is expelled the above procedure is reversed: the corrugated plates 87 are pulled back into the duct 24 by reversing the movement of the piston rod 124. After the corrugated plates 87 are returned to their operating position within the duct 24, the side cylinder 142 is reversed, so that the piston rod 143 moves downwardly causing the lever systems 140 to reverse direction, first moving the lower plate 132 to its closed position and then the side plate 131 to its closed position.

During movement of the plates 87, the upper track 198 is maintained at the proper spacing from the lower track. This is accomplished by permitting limited movement of the upper track 198, as permitted by the spring hangers 122 and limited by the stop members 123.

Rubber flap seals 151 are provided to limit the entry of sediment into the track housing 100*a,b*. The flaps 151 are secured to the housing 100*a,b*and are pressed against the support plates 86*a,b*, permitting sliding movement of the plates 86*a,b*.

Other types of undulating plates, and other means of causing the at least temporary separation of the undulating plates as they are pulled out of the duct, can be provided. Similarly, other drive means for opening the duct walls and/or transversely moving the plates can be provided, such as an electric motor. In addition, the set of plates can be moved simultaneously upwardly or downwardly, instead of serially sideways, and the plates spread apart as they move outside of the conduit.

Alternatively, the track can be substantially straight and the undulating plates be attached to each other by variable length connecting means. Thus, when the train of undulating plates are pulled out along the track, or by the piston rod, the plates separate as the first plates move out beyond the conduit. When the plates are pushed back into the conduit, they return to their operating position. In this embodiment, when the conduit sides, e.g., the side plates 131, 132 in FIG. 3 can open, it is not necessary to move all of the plates to outside of the conduit in order to separate the adjacent plates and release trapped material.

The patentable embodiments of this invention which are claimed are as follows:

1. Screening means for preventing the passage of long slender objects carried by liquid flowing through a conduit, said screening means comprises:

(1) a conduit for liquid flow having a longitudinal axis extending along the conduit, and having a first wall, a portion of which is movable to open the conduit;

(2) a plurality of adjacent, complementary corrugated plates, movably secured within the conduit, and located adjacent the movable portion of the first wall, the opposed major surfaces of each adjacent pair of plates defining a serpentine, restricted flow passage therebetween, the axes of the corrugations of the plates being substantially mutually parallel and extending in a direction perpendicular to the longitudinal axis of the conduit;

(3) means for remotely opening the movable wall portion of the conduit, the movable conduit wall portion extending parallel to the axes of curvature of the plates; and (4) means for remotely moving at least some of the plurality of corrugated plates as a group to outside of the conduit through the opening defined by the movable wall portion and in a direction transverse to the longitudinal axis of the conduit and transverse to the axes of the corrugations while at least instantaneously increasing the distance separating the corrugated surfaces of the adjacent plates when the plates are outside of the conduit, and for returning the corrugated plates to their positions within the conduit.

2. The screening means of claim 1 wherein each corrugated plate is connected to an adjacent corrugated plate, such that moving one corrugated plate causes movement of the adjacent corrugated plate and wherein the means for remotely moving and separating the corrugated plates from one another comprises:

(1) slide support means secured to and extending beyond at least the movable portion of the first wall and transversely to the longitudinal axis of the conduit;

(2) means for slidably connecting the corrugated plates to the slide support means such that the corrugated plates are able to move along the slide support means; and (3) means for moving the corrugated plates along the slide support means and for separating the corrugated plates from one another as the corrugated plates are moved along the slide support means, and for returning the corrugated plates to their positions within the conduit.

3. The screening means of claim 2 wherein the slide support means comprises two parallel tracks.

4. The screen ing means of claim 3 wherein the means for separating the corrugated plates from one another comprises an outward bend in the tracks, bending away from the conduit.

5. The screening means of claim 3 wherein the means for slidably connecting the corrugated plates to the tracks comprises a pair of rollers, rotatably connected to the plates and rollably mounted on the tracks.

6. The screening means of claim 4 wherein the plates are interconnected such that they are hingedly interconnected,

7. The screening means of claim 1 wherein the plates are interconnected in series.

8. The screening means of claim 7 wherein the means for moving the plates is attached to the plate adjacent the movable first wall portion such that the remaining plates are pulled by the first plate.

9. The screening means of claim 1 comprising a transverse screening member, secured transversely to each corrugated plate.

10. The screening means of claim 9 wherein the transverse member is a plate perpendicularly secured to the curved surface of each corrugated plate.

11. The screening means of claim 9 comprising a plurality of transverse screening members axially spaced along at least one surface of each corrugated plate.

12. The screening means of claim 1 wherein the conduit comprises a second wall extending transverse to the first openable wall of the conduit and having a portion which is movable to open the conduit, and further comprising means for opening said movable portion of the second wall, said movable portion of said second wall being adjacent the movable portion of the first wall, the second wall extending transverse to the axes of curvature of the plates.

13. In a dredge means for collecting particles from the floor of the ocean, the particles entering the dredge means together with a large volume of water, the dredge means comprising: a nozzle having a nozzle inlet designed to be located adjacent to the ocean floor; liquid pumping means for drawing a flow of liquid with suspended solids into and through the nozzle inlet; and conduit having a longitudinal axis extending along the conduit, the nozzle and conduit defining an internal flow channel between the nozzle opening and the pumping means; the improvement comprising, a first side of the conduit, a portion of which is movable to open the conduit, screening means suitable for excluding long slender objects from passing through the flow channel, the screening means comprising a plurality of adjacent plates having corrugated surfaces, the plates being movably secured to the conduit such that in a first position within the flow channel the corrugated opposed surfaces of adjacent plates define curved, restricted flow passages within the conduit, the axes of the curves of which extend transversely to the longitudinal axis of the flow channel; and means for remotely cleaning the screening means comprising (1) means for remotely opening the movable portion of the first side of the conduit adjacent to the undulating plates; and (2) means for remotely moving at least some of the plates to outside of the conduit through the opening defined by said movable portion and in a direction transverse to the direction of fluid flow in the conduit while at least instantaneously increasing the distance separating the adjacent plates when the plates are outside of the conduit, and for returning the plates to inside of the conduit.

14. The dredging means of claim 13 wherein the corrugated plates have opposing surfaces that are substantially mutually parallel.

15. The dredging means of claim 13 comprising in addition a plurality of transverse screening means mounted on each of the corrugated plates and being axially spaced therealong.

16. Screening means for preventing the passage of long slender objects carried by liquid flowing through a conduit, such screening means comprises:

(1) a conduit for liquid flow having a longitudinal axis extending along the conduit, and comprising a first side and a second side, a portion of, each of which is movable to open the conduit, the second side extending transverse to the first side;

(2) a plurality of adjacent, complementary corrugated plates, movably secured within the conduit, the opposed major surfaces of each adjacent pair of plates defining a serpentine, restricted flow passage therebetween, the axes of the corrugations of the plates being substantially mutually parallel and extending in a direction perpendicular to the longitudinal axis of the conduit;

(3) means for remotely opening the movable portion of the first side of the conduit adjacent to the plates, the movable portion extending parallel to the axis of the plates; and (4) means for remotely moving at least some of the plurality of corrugated plates as a group to outside of the conduit through the opening defined by said movable portions and in a direction transverse to the longitudinal axis of the conduit and transverse to the axes of the corrugations while at least instantaneously increasing the distance separating the corrugated surfaces of the adjacent plates when the plates are outside of the conduit;

(5) means for remotely opening the movable portion of the second side of the conduit adjacent and transverse to the movable portion of the first side of the conduit, the second side extending transverse to the axes of curvature of the plates; and (6) means for hingedly interconnecting the first and second movable portions of the conduit to the remaining portion of the conduit.

* * * * *